United States Patent [19]

Small et al.

[11] 4,118,907

[45] Oct. 10, 1978

[54] LIFTING EQUIPMENT HAVING TELESCOPIC BOOM WITH AUTOMATIC EXTENSION LIMITING

[75] Inventors: Robert F. Small, San Jose; Joel B. Meredith, San Carlos, both of Calif.

[73] Assignee: General Cable Corporation, San Carlos, Calif.

[21] Appl. No.: 846,195

[22] Filed: Oct. 27, 1977

[51] Int. Cl.[2] ..... E04H 12/34

[52] U.S. Cl. ..... 52/115; 52/118; 182/19

[58] Field of Search ..... 52/115, 118; 182/19; 212/39 MS, 55

[56] References Cited

U.S. PATENT DOCUMENTS

| | | | |
|---|---|---|---|
| 2,936,847 | 5/1960 | Eitel | 182/19 X |
| 3,035,712 | 5/1962 | Nowack | 182/19 UX |
| 3,461,989 | 8/1969 | Prescott et al. | 182/19 |
| 3,949,833 | 4/1976 | Kozai | 182/19 |

*Primary Examiner*—Price C. Faw, Jr.
*Assistant Examiner*—Carl D. Friedman
*Attorney, Agent, or Firm*—Flehr, Hohbach, Test, Albritton & Herbert

[57] ABSTRACT

Mobile lifting equipment having a wheeled vehicle with a frame. The boom structure is mounted on the frame for rotation about a vertical axis, raising and lowering the same about a horizontal axis and for extension and retraction with respect to the vehicle. The boom structure includes an outer boom and an inner boom which is mounted for telescoping movement in the outer boom. First and second extension cylinders are carried by the outer boom for extending and retracting inner boom with respect to the outer boom. An elevation cylinder is connected to the outer boom and is provided for raising and lowering of the boom structure. An elevation control is prcvided for supplying hydraulic fluid to the elevation cylinder. Piping is provided for connecting the elevation cylinder to one of the first and second extension cylinders so that extension of said one of said first and second extension cylinders is limited by the amount of hydraulic fluid which has been supplied from the elevation cylinder.

7 Claims, 5 Drawing Figures

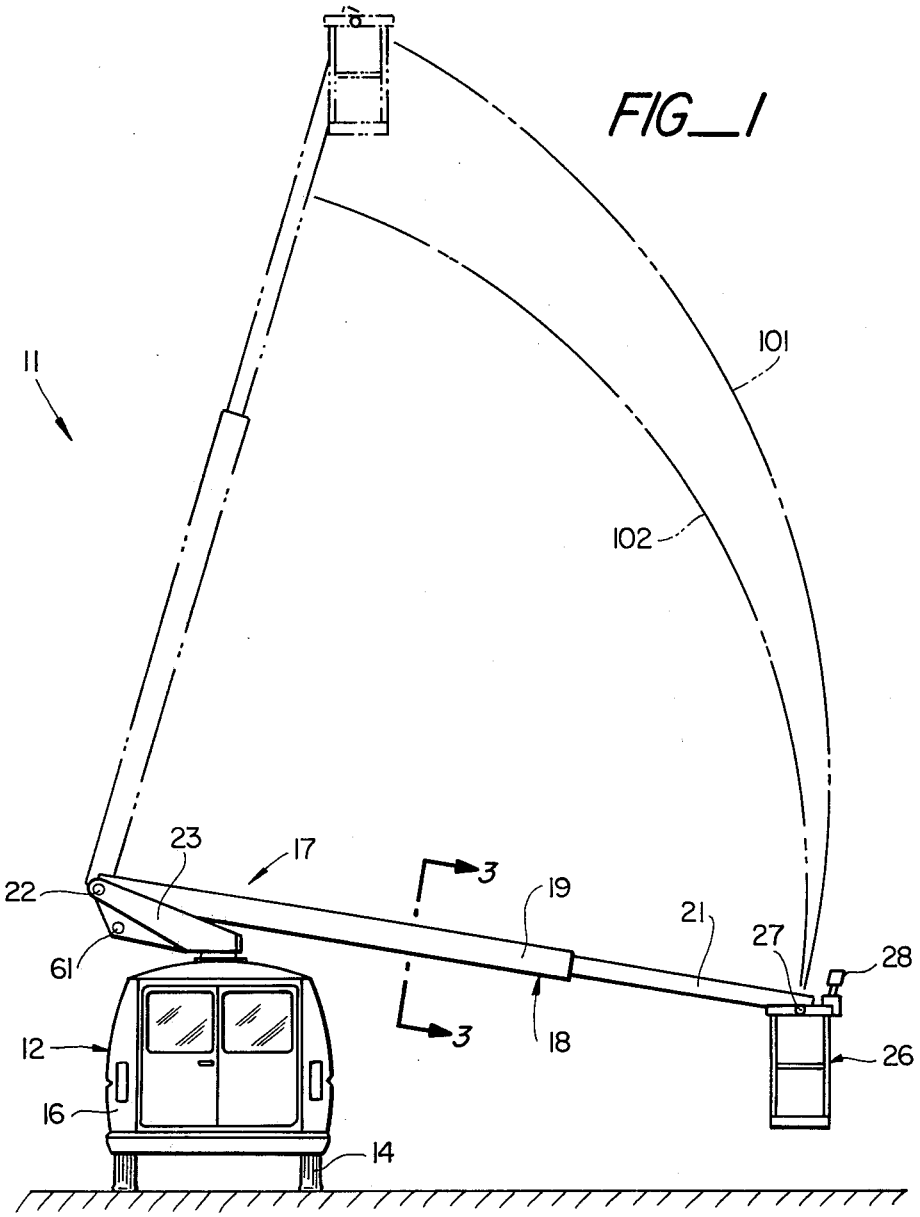
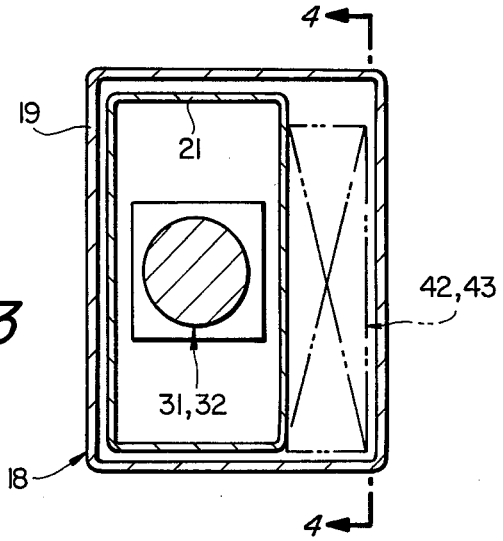
FIG_3

LIFTING EQUIPMENT HAVING TELESCOPIC BOOM WITH AUTOMATIC EXTENSION LIMITING

BACKGROUND OF THE INVENTION

In the U.S. Pat. No. 2,936,847 issued on May 17, 1960, there is disclosed a mobile lifting equipment with an extensible boom structure which includes controls which will prevent movement of the boom structure into zones or sectors which would cause the vehicle to tip over. These controls which are provided serve to prevent downward movement of the boom structure below a certain angle when the boom structure is in certain danger sectors or zones until the outer end of the boom is retracted a predetermined distance. Such control systems have the disadvantage in the event that they become operative to prevent the lowering of the boom, some means must be provided for overriding the controls so that the boom can be retracted and brought back to the ground. Such control systems also have the disadvantage in that they are relatively complicated. There is therefore need for a new and improved lifting equipment having a telescoping boom with automatic extension limiting which overcomes such disadvantages.

SUMMARY OF THE INVENTION AND OBJECTS

The mobile lifting equipment consists of a wheeled vehicle which has a frame which is carried by the wheels. A boom structure is mounted on the outer frame in such a manner so that its outer end can be rotated about a vertical axis, raised and lowered about a horizontal axis and extended and retracted with respect to the vehicle. The boom structure includes an outer boom and inner boom mounted for telescopic movement with respect to the outer boom. First and second extension cylinder assemblies are carried by the outer boom for extending and retracting inner boom with respect to the outer boom. An elevation cylinder assembly is connected to the outer boom for raising and lowering the boom structure. Means is provided for supplying hydraulic fluid to the elevation cylinder. Means is provided for connecting the elevation cylinder to one of the first and second extension cylinders so that the extension of said one of said first and second extension cylinders is limited by the amount of hydraulic fluid which has been supplied from the elevation cylinder.

In general, it is an object of the present invention to provide a mobile lifting equipment having a telescopic boom with automatic extension limiting which does not require an override.

Another object of the invention is to provide lifting equipment of the above character in which the amount of fluid supplied to an elevation cylinder is utilized for controlling the extension of an extension cylinder.

Another object of the invention is to provide lifting equipment of the above character which makes it possible to utilize lighter vehicles.

Another object of the invention is to provide lifting equipment of the above character in which the size of the extension cylinders can be reduced.

Another object of the invention is to provide lifting equipment of the above character in which the operation of the elevation and one of the extension cylinders is synchronized.

Another object of the invention is to provide lifting equipment of the above character which makes it possible to reduce the weight of the boom structure.

Another object of the invention is to provide lifting equipment of the above character in which self-supporting track structures are utilized for the control lines.

Additional objects and features of the invention will appear from the following description in which the preferred embodiment is set forth in detail in conjunction with the accompanying drawings.

BRIEF DESCRIPTION OF THE DRAWINGS

FIG. 1 is a rear elevational view of a lifting equipment incorporating the present invention and showing the ranges of movement for the boom structure.

FIG. 3 is a cross sectional view taken along the line 3—3 of FIG. 1.

DESCRIPTION OF THE PREFERRED EMBODIMENT

Figure 2:
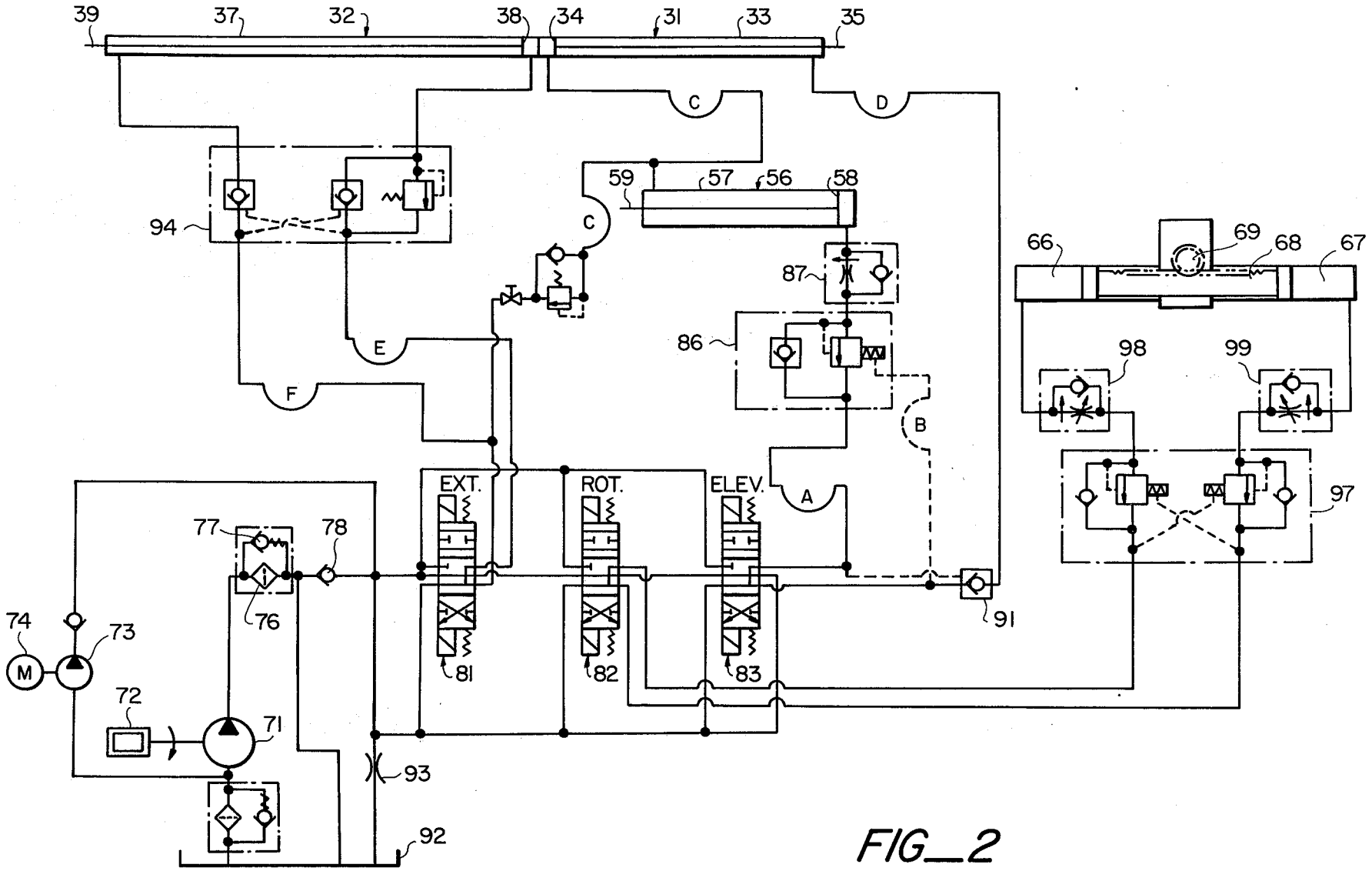
FIG. 2 is a schematic diagram of the hydraulic system utilized in the lifting equipment.

The mobile lifting equipment 11 incorporating the present invention is shown in FIG. 1. It consists of a wheeled self-propelled vehicle 12 which can be of the type disclosed in U.S. Pat. No. 3,480,109. As disclosed therein, it is provided with a pair of front wheels (not shown) and a pair of rear wheels 14 which are rotatably mounted on the chassis or framework (not shown) that serves as a platform. Suitable motive means (not shown) is provided for supplying power to the rear wheels 14 of the vehicle. A van-type body 16 is mounted on the chassis or framework. The vehicle is provided with a driving station (not shown) permitting a driver to move the vehicle from one location to another.

A lifting apparatus 17 is mounted in the van-like body and is supported on the chassis or framework as disclosed in U.S. Pat. No. 3,480,109. The lifting apparatus includes a boom structure 18 which includes first and second boom sections 19 and 21 in which the first boom section 19 can be characterized as the outer boom section and the second boom section can be characterized as the inner boom section which is mounted for telescopic movement with respect to the outer boom section.

One end of the outer boom section 19 is pivotally connected by a pin 22 to a pair of support arms 23 for movement about a horizontal axis. The support arms 23 are adapted to be rotated about a vertical axis as hereinafter described. A workman's basket or platform 26 is carried by the outer end of the boom structure 18 by pivotally connecting the same at 27 to the outer end of the inner boom section 21. A control mechanism 28 is mounted in the workman's basket so that it can be grasped by a workman in the basket to control the movement of the basket 26 carried by the outer end of the boom structure 18 as hereinafter described. The control mechanism 28 is utilized for controlling the motion of the workman's basket so that the workman's basket can be raised and lowered about a horizontal axis rotated about the vertical axis and moved towards and away from the vehicle by extending and retracting the inner telescopic boom section with respect to the outer boom section.

First and second extension cylinder assemblies 31 and 32 are provided within the outer boom section 19 and are provided for extending and retracting the inner boom section 21 with respect to the outer boom section 19. The first extension cylinder assembly 31 consists of a cylinder 33 which is provided with a piston 34 and a piston rod 35 which is connected to the rear extremity of the outer boom section 19 by a nut and post assembly 36. The cylinder 33 of the first extension cylinder assembly 31 is secured to a cylinder 37 of the second extension cylinder assembly 32. A piston 38 and piston rod 39 are mounted in the cylinder 37. The piston rod 39 is connected to the inner boom section 21 by a nut and post assembly 40. The two cylinder assemblies are of suitable lengths as, for example, each cylinder can have a length of approximately 11 feet and the piston rod can have a length of approximately 11 feet for a total of 22 feet for each cylinder assembly. Each of the cylinders is provided with openings (not shown) at opposite ends on opposite sides of the pistons.

Figure 4A:
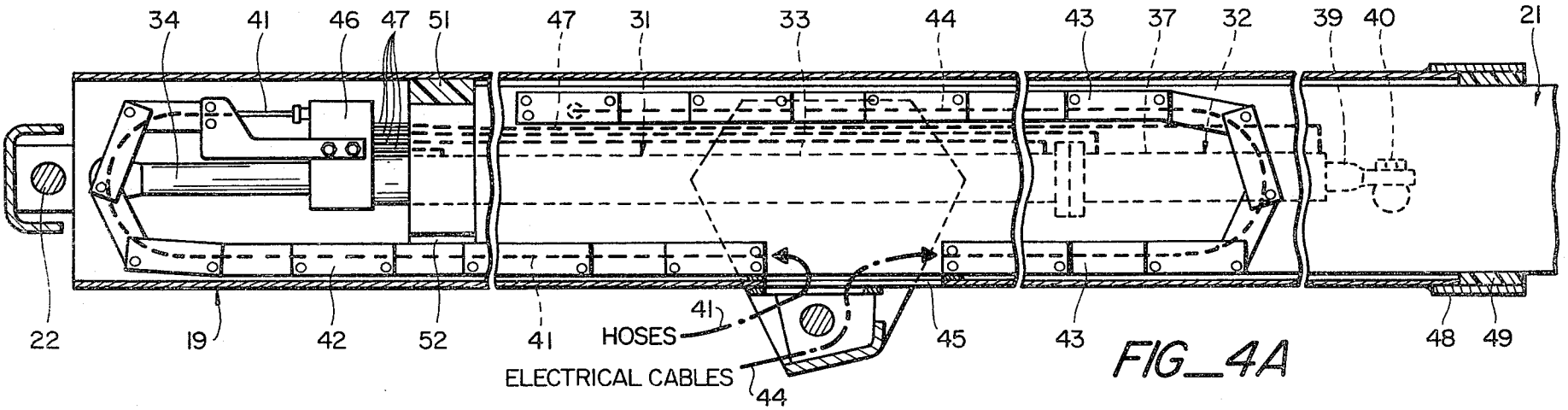
FIGS. 4A and 4B are cross sectional views taken along the line 4—4 of FIG. 3.
Figure 4B:
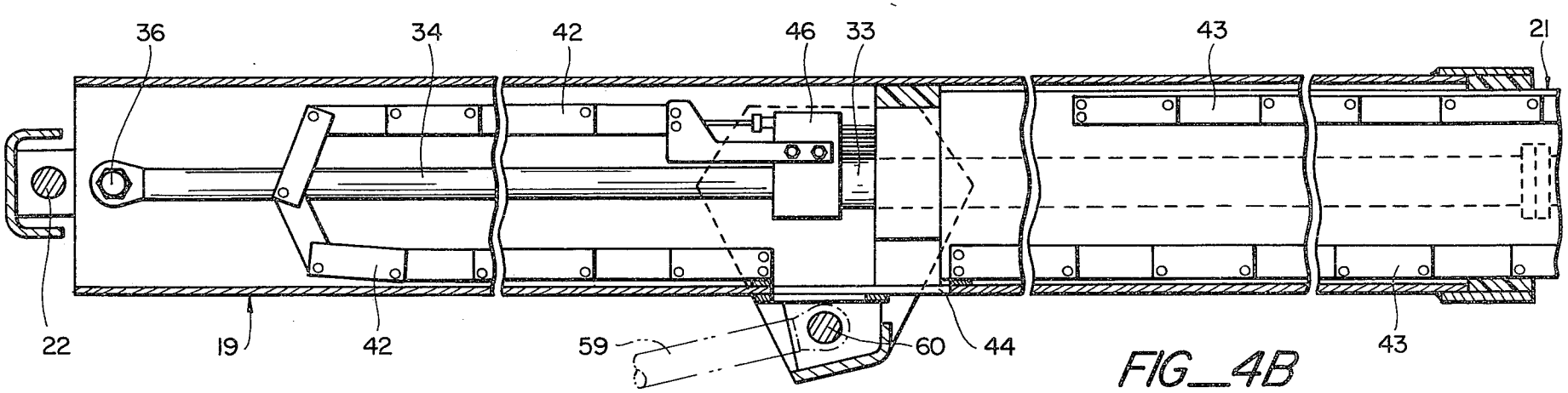

Means is provided for supplying hydraulic fluid to the openings in the cylinders to cause extension of the piston rods and in both of the extension cylinder assemblies 31 and 32 and consists of hoses 41 carrying hydraulic fluid which are mounted in a first self-supporting track structure 42. The electrical control cables 44 connecting the control mechanism 28 in the workman's basket 26 to the control panel (not shown) mounted on the lifting apparatus are carried by a second self-supporting track structure 43. The track structures 43 and 43 are of a conventional type and are constructed in a manner similar to that described in the U.S. Pat. No. 3,480,109. The hoses 41 enter through an opening 45 provided in the outer boom assembly 19 and extend through the first track structure 42. The first track structure 42 has one end fixed to the outer boom 19 adjacent one side of the opening 45. The first track structure extends rearwardly from the opening 45 and forms a U-shape as shown in FIGS. 4-A and 4-B and is connected to a block 46 secured to the rearmost extremity of the cylinder 33. Rigid piping extending parallel with the cylinders 33 and 37 connects the hoses mounted in the block 45 to opposite ends of the cylinders 33 and 37 to supply hydraulic fluid thereto as hereinafter described. Control cables 44 also extend through the opening 45 into the second track structure 43 which has one end secured to the outer boom section 19 adjacent the opening 44 and which extends forwardly in the outer boom in a U-shaped fashion and has its other end secured to the inner boom section 21. The cables 44 extend from the second track structure 43 to the control mechanism 28. If desired a supply of pneumatic air can be supplied to the workmen's basket 26 by placing such hoses in the second track structure 43.

As can be seen, the outer extremity of the outer boom section 19 is provided with a collar 48 which carries a sleeve 49 formed of a suitable material such as plastic in which inner boom section 21 is adapted to slide. The rear extremity of the inner boom section is provided with a collar 51 formed of a suitable material such as plastic which is adapted to slide within the outer boom section 19. The collar 51 is provided with a slot 52 so that the track structures 42 and 43 can pass therethrough. As can be seen from FIG. 3, the track structures 42 and 43 are mounted on one side of the outer boom section adjacent the inner boom section.

The means for raising and lowering the outer end of the boom structure 18 about the horizontal axis includes an elevation cylinder assembly 56 which comprises a cylinder 57, a piston 58 and a piston rod 59. The piston rod 59 is pivotally connected to the outer boom section 19 by a pin 60. The cylinder 57 is pivotally connected to the support arms 23 by a pin 61 (see FIG. 1).

For the rotational drive for the lifting equipment, there is provided first and second azimuth drive cylinder assemblies 66 and 67 which drive a rack 68 in opposite directions. The rack 68 drives a pinion 69 which causes rotational movement of the outer end of the boom structure about a vertical axis.

A schematic diagram for the piping for supplying hydraulic fluid to the various cylinder assemblies hereinbefore described is shown in FIG. 2. As shown therein, it consists of a main hydraulic pump 71 of a suitable capacity as, for example, one delivering hydraulic fluid at a rate of 1½ gallons per minute at 2,000 psi. This pump is driven by a suitable source of power such as a gasoline engine 72. An emergency pump 73 capable of providing a suitable capacity as, for example, one-half gallon per minute at 2,000 psi is provided and is driven by a small electric motor as, for example, a 12-volt DC motor which can be driven from the battery of the vehicle on which the lifting equipment is mounted. The hydraulic fluid under pressure is supplied from the pump 71 or alternately from the pump 73 to a filter 76. The filter 76 is provided with a bypass valve 77 which will bypass the hydraulic fluid at a suitable pressure as, for example, 80 psi. The hydraulic fluid is then supplied through a check valve 78. The hydraulic fluid is supplied from the check valve 78 in parallel to three solenoid operated directional control valve assemblies 81, 82, and 83, with 81 being for extension, 82 for rotation and 83 for elevation. The solenoid operated directional control valve assemblies 81, 82 and 83 are conventional and therefore will not be described in detail.

Let it be assumed that hydraulic fluid is supplied through the direction control valve assembly 83 under the control of the control mechanism 28 to hose A to the check valve section of a pilot operated holding valve 86 and then to the free flow bypass check valve of a flow control valve 87 which controls the flow to a suitable rate as, for example, one gallon per minute. Thereafter the hydraulic fluid is delivered to one end of the cylinder 57. This fluid forces the piston 58 to the left as viewed in FIG. 2 and causes the piston rod 59 to be extended this causes the boom structure 18 to be gradually elevated about the horizontal axis 22. At the time that the piston rod 58 is being moved outwardly, oil is displaced from the cylinder 57 and passes through hose C and delivers the same to one end of the cylinder 33. This causes the piston rod 35 to be extended to cause extension of the inner telescoping boom 21 with respect to the outer telescoping boom. Hydraulic fluid displaced from the other side of the piston rod is displaced through the hose D to a pilot operated check valve 91 and thence is returned to a drain tank 92 through an orifice 93.

From this mode of operation it can be seen that the amount of extension by the lower extension cylinder is directly proportional to the amount of extension provided by the elevation cylinder because the amount of extension of the elevation cylinder is determined directly by the fluid which is introduced into the elevation cylinder. The same quantity of fluid is also introduced into the lower extension cylinder to cause it to be extended a proportional amount, the amount being directly proportional to the sizes of the respective cylinders.

When it is desired to reverse the extension of the inner boom structure by retracting the lower extension piston rod 35, the directional control valve assembly 81 is operated to cause the hydraulic fluid to flow in a reverse direction. Hydraulic fluid is then delivered through the pilot operated check valve 91 through the hose D and then into the cylinder 33 to cause the piston rod 35 to be retracted. Hydraulic fluid is supplied from the cylinder 33 through hose C to the cylinder 56 to cause the piston 58 to be retracted. This causes fluid to be supplied through the flow restrictor assembly 87 through the pilot operated holding valve assembly 86 through hose A which permits hydraulic fluid to pass from the cylinder 57 into the tank 92.

Thus it can been seen that the operation of the elevation cylinder 56 and the lower extension cylinder 31 are interrelated and that one cannot be operated without operating the other.

As shown from the diagram in FIG. 1, the mobile lifting equipment 11 has its greatest instability when the boom structure is moved to the side as shown in FIG. 1. It also can been seen that the amount of side reach which is provided is a function of elevation. As the elevation is increased, the extension of the inner boom can be increased. The upper extension cylinder assembly 32 can be operated to its full extent in any position of the boom structure 18. It is only the inner boom section which can only be moved to an extension as determined by the amount of elevation and this is directly determined by the amount of fluid which is supplied to the elevation cylinder and which in turn is directly proportional to the fluid which is applied to the lower extension cylinder assembly 31.

The operation of the upper extension cylinder 32 is always under the control of the operator in the workman's basket by operating the control mechanism and these controls can be operated to control the directional control valve assembly 81. Fluid is supplied through hose E to a double pilot check and relief valve assembly 94. Hydraulic fluid is then supplied to the cylinder 37 to cause the piston rod 39 to be advanced. As this occurs, the inner boom section 21 is further extended. Hydraulic fluid passes from the cylinder 37 through the double pilot check and relief valve assembly 94 through hose F and then back into the tank 92. When it is desired to retract the piston rod 39, the directional control valve 81 is operated to cause fluid to be supplied through hose F into the cylinder 37 to cause fluid to flow from the other end of the hose 37 through hose E and back to the tank 92. Thus, it can be seen that the operation of the upper extension cylinder assembly 32 is completely independent of the extension of the lower extension cylinder 31.

Similarly, the azimuth drive is controlled in a similar manner by the control mechanism 28. The directional control valve assembly 82 is operated to supply hydraulic fluid through a double holding valve assembly 97 and then through a flow restrictor assembly 98 to supply fluid to the hydraulic cylinder 66 to cause the rack 68 to be moved to the right as shown in FIG. 2 and to thereby cause counterclockwise movement of the pinion 69. Conversely, when fluid is supplied through the other flow control valve assembly 99, hydraulic fluid is supplied to the other hydraulic cylinder 67 to cause rack 68 to be moved in an opposite direction to cause clockwise rotation of the pinion 69. This rotational movement of the pinion 69 causes the boom structure to be rotated about a vertical axis in a conventional manner. When fluid is being introduced into the cylinder 66 fluid is being taken from the other cylinder 67 and is being drained into the tank 92. A filter assembly 99 is provided between the tank 92 and the pump 71.

In FIG. 1 there is shown a diagram of the range of movements which can be provided. The curve 101 shows the maximum travel of the inner extension boom with respect to the outer extension boom with automatic extension limiting. The spacing between curve 102 and curve 101 shows the amount of additional extension which can be obtained at various elevations by the use of the boom tricking arrangement herein described which permits greater extension or elevation increases.

It can be seen from the foregoing that there has been provided a foolproof system for limiting the extension of the boom structure so that the vehicle cannot be accidentally overturned by over-extension of the boom structure. By providing such automatic extension limiting means, it is possible to mount the lifting equipment upon a lighter weight vehicle than would normally be the case. It also makes it unnecessary to utilize other means for maintaining the stability of the vehicle during the time that the lifting equipment is being utilized.

By utilizing a double cylinder assembly for the extension, it is possible to greatly reduce the expense of the cylinder assemblies because it is less expensive to purchase two smaller cylinder assemblies than one larger cylinder assembly, particularly in the case where long length cylinder assemblies are required as in the present application. In addition to a decrease in cost, there is a decrease in the weight which is added to the boom structure thereby increasing the effective reach of the lifting equipment.

For the present arrangement hereinbefore described, it can be seen that the cylinders can be sized so that it makes it impossible for an operator to operate outside a safe range for the boom structure. There is no necessity for an override because the boom can always be powered back to its retracted position.

It is apparent from the foregoing that there has been provided new and improved lifting equipment which is failsafe and does not require an override. By the utilization of two extension cylinders, the cost and weight of the extension cylinders are greatly reduced. This makes it possible to mount the lifting equipment on smaller size vehicles without danger of overturning.

What is claimed is:

1. In a mobile lifting equipment, a wheeled vehicle having a frame, a boom structure mounted on the frame for rotation about a vertical axis, raising and lowering about a horizontal axis and extension and retraction with respect to the vehicle, said boom structure including an outer boom and inner boom mounted for telescoping movement in the outer boom, first and second extension cylinder assemblies carried by the outer boom for extending and retracting the inner boom with respect to the outer boom, an elevation cylinder assembly connected to the boom structure, each of the cylinder assemblies including a cylinder, a piston slidably mounted in the cylinder and a piston rod connected to the piston, each of the cylinders having openings at opposite ends thereof on opposite sides of the piston in the cylinder, means connecting one of the openings of the elevation cylinder to one of the openings of one of the first extension cylinder so that hydraulic fluid can be transferred between the elevation cylinder and the first extension cylinder, a drain tank, sump means connected to the drain tank for supplying hydraulic fluid to the other of the openings of the elevation cylinder for causing movement of the piston in the elevation cylinder, means connecting the other of the openings of said first extension cylinder to the drain tank so that as the boom structure is elevated, the inner boom section is moved relative to the outer boom section so that the extension of said first extension cylinder assembly is controlled directly by the amount of hydraulic fluid supplied to the elevation cylinder assembly, means connecting the pump means to one of the openings of the second extension cylinder and means connecting the other opening of the second extension assembly to the drain tank so that the inner boom structure can be extended and retracted independent of the action of the elevation cylinder assembly.

2. A mobile lifting equipment as in claim 1 together with means for causing rotation of the boom structure about the vertical axis.

3. A mobile lifting equipment as in claim 2 wherein said means for causing rotation of said boom structure about the vertical axis includes a rack, first and second cylinders connected to opposite ends of the rack and a pinion driven by said rack.

4. A mobile lifting equipment as in claim 1 wherein said first and second extension cylinder assemblies are mounted end to end and means connecting said first and second cylinder assemblies between said outer and inner boom sections.

5. A mobile lifting equipment as in claim 1 together with flexible hoses connected to said first and second extension cylinders, and self supporting track structures mounted in said outer boom section and carrying said hoses to permit extension and retraction of said inner boom section.

6. A mobile lifting equipment as in claim 5 wherein said self supporting track structures are mounted alongside said inner boom section.

7. A mobile lifting equipment as in claim 5 wherein said outer boom is provided with an opening through which the flexible hoses extend and wherein one end of each of the self supporting track structures is located in close proximity to said opening.

* * * * *